US007748756B2

(12) United States Patent
Kanamaru et al.

(10) Patent No.: US 7,748,756 B2
(45) Date of Patent: Jul. 6, 2010

(54) LOCK MECHANISM

(75) Inventors: Masahiro Kanamaru, Shizuoka-ken (JP); Makoto Nakayama, Shizuoka-ken (JP); Tarou Inoue, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 187 days.

(21) Appl. No.: 11/965,232

(22) Filed: Dec. 27, 2007

(65) Prior Publication Data

US 2008/0209961 A1 Sep. 4, 2008

(30) Foreign Application Priority Data

Dec. 27, 2006 (JP) ..... 2006-352311

(51) Int. Cl.
*E05C 19/06* (2006.01)

(52) U.S. Cl. ..... 292/80; 292/81; 292/DIG. 11; 292/DIG. 38; 292/DIG. 53

(58) Field of Classification Search ..... 292/80, 292/56, 19, 95, 125, 225, 303, 81, 84, 87, 292/89, DIG. 11, DIG. 38, DIG. 53, DIG. 54, 292/DIG. 64
See application file for complete search history.

(56) References Cited

U.S. PATENT DOCUMENTS 5,938,063 A * 8/1999 Hoftman ..... 220/326
5,992,953 A * 11/1999 Rabinovitz ..... 312/111
6,094,785 A * 8/2000 Montgomery et al. ..... 24/324
6,129,395 A * 10/2000 Schlesener et al. ..... 292/128
7,129,997 B1 * 10/2006 Kim et al. ..... 348/836
7,383,029 B2 * 6/2008 Sasaki et al. ..... 455/128

FOREIGN PATENT DOCUMENTS

JP 2002-354632 12/2002

* cited by examiner

*Primary Examiner*—Peter M. Cuomo
*Assistant Examiner*—Mark Williams
(74) *Attorney, Agent, or Firm*—Finnegan, Henderson, Farabow, Garrett & Dunner, L.L.P.

(57) ABSTRACT

In a sidewall of a connector frame, a cantilevered lock arm is provided. A lower end of the lock arm is connected to the sidewall with a curved supporting unit interposed therebetween. The lock arm extends upward from the supporting unit with a space. The supporting unit has a slit to increase the flexibility of the lock arm. An engagement protrusion is provided on the lock arm. Moreover, a fitting sidewall is provided in a box body, and a lock wall having a lock protrusion is provided outside the fitting sidewall. The lock protrusion includes a downward-facing engagement surface. A mold hole used in molding the engagement surface is formed between the fitting sidewall and lock wall. An abutment surface is provided at an upper end of the fitting sidewall and contacted with the supporting unit to close communication between the mold hole and the slit.

3 Claims, 7 Drawing Sheets

LOCK MECHANISM

BACKGROUND OF THE INVENTION

1. Field of the Invention

The present invention relates to a lock mechanism applied to an electrical junction box which is mounted on an automobile or the like.

2. Description of the Related Art

In an electrical junction box which is mounted on an automobile, a lock mechanism integrally molded on each part is used to join molded parts of resin to each other. Japanese Patent Laid-open Publication No. 2002-354632 shows a lock mechanism provided for peripheries of an electrical component attachment block and a lower cover covering the bottom surface of the same.

This type of lock mechanism is often used for a part and a housing box accommodating the part. In this case, a lock arm including an engagement protrusion is integrally molded on the outer surface of a sidewall of the part. On the other hand, a lock protrusion which is engaged with the engagement protrusion is integrally molded on the inner surface of a sidewall of the housing box. As the part is inserted from above into the housing box, the lock arm is bent, and the engagement protrusion on the lock arm gets over the lock protrusion of the housing box. Eventually, the engagement protrusion and lock protrusion are locked to each other so that the part does not escape upward.

In the case where there is a need to prevent water intrusion from the outside like an electrical junction box mounted in an engine room, a waterproof structure is required. In this regard, the lock mechanism provided for resin molded products often includes a hole which can act as a water intrusion path because of the complicated shape thereof, molding reasons, and the like.

SUMMARY OF THE INVENTION

In the light of the above circumstances, an object of the present invention is to provide a lock mechanism which provides a high waterproof property even if including a hole which can act as a water intrusion path.

An aspect of the present invention is a lock mechanism between a part and a housing box which accommodates the part from above, the lock mechanism including: a cantilevered first lock unit provided on a first sidewall of the part, the first lock unit including: a supporting unit connected to the first sidewall, the supporting unit having: a curved surface; and a slit formed in the middle of the supporting unit in a width direction thereof; a lock arm forming a band plate shape, extending upward from the supporting unit with a deflection space in which the lock arm is deflected to the first sidewall; and a first engagement protrusion provided on an outer surface of the lock arm; and a second lock unit provided in the housing box to be engaged with the first lock unit, the second lock unit including: a second sidewall of the housing box, fitted to the first sidewall of the part from below; a third sidewall of the housing box, provided in the outside of the second sidewall substantially in parallel to the second sidewall; a second engagement protrusion provided on the third sidewall to be engaged with the first engagement protrusion; a mold hole formed between the second and third sidewalls; and an abutment surface formed at an upper end of the second sidewall and configured to close communication between the mold hole and slit by contact with the curved surface of the supporting unit.

According to the aforementioned structure, it is possible to prevent water intrusion above the abutment surface even when water (droplets) is intruded from the lower end of the mold hole. In other words, such a communicating hole formed due to a structural reason is closed by bringing the abutment surface of the upper end of the fitting sidewall to the supporting unit of the lock arm, thus preventing water intrusion. Adding such a simple structure can solve the structural problem.

In addition to the aforementioned constitution, the lock mechanism may include: first slide guides vertically provided on both sides of the lock arm on the first side wall; and second slide guides provided on both sides of the second engagement protrusion on the third sidewall, and preferably the first and second slide guides are vertically and slidably engaged with each other.

According to the aforementioned constitution, the engagement of the first and second slide guides allows the first and second engagement protrusions to be smoothly engaged. Moreover, the slide guides can receive external force other than that force in a direction that the housing box is fitted to the part, so that unnecessary force is not applied to the lock part, thus stabilizing the locked state.

DETAILED DESCRIPTION OF THE EMBODIMENT

A description is given of an embodiment of the present invention below with reference to the drawings.

Figure 1:
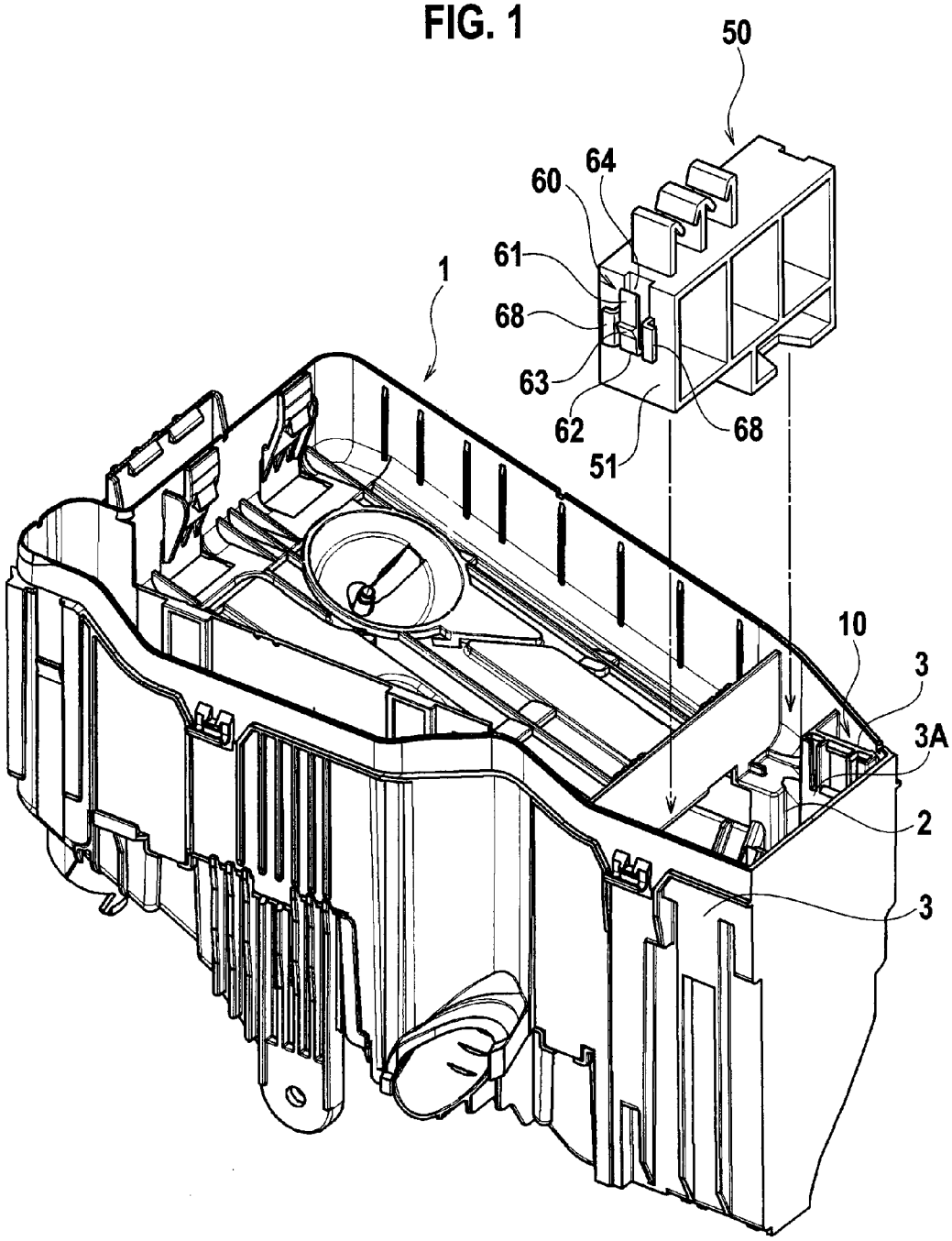
FIG. 1 is a perspective view of an electrical junction box to which a lock mechanism of an embodiment of the present invention is applied.
Figure 2:
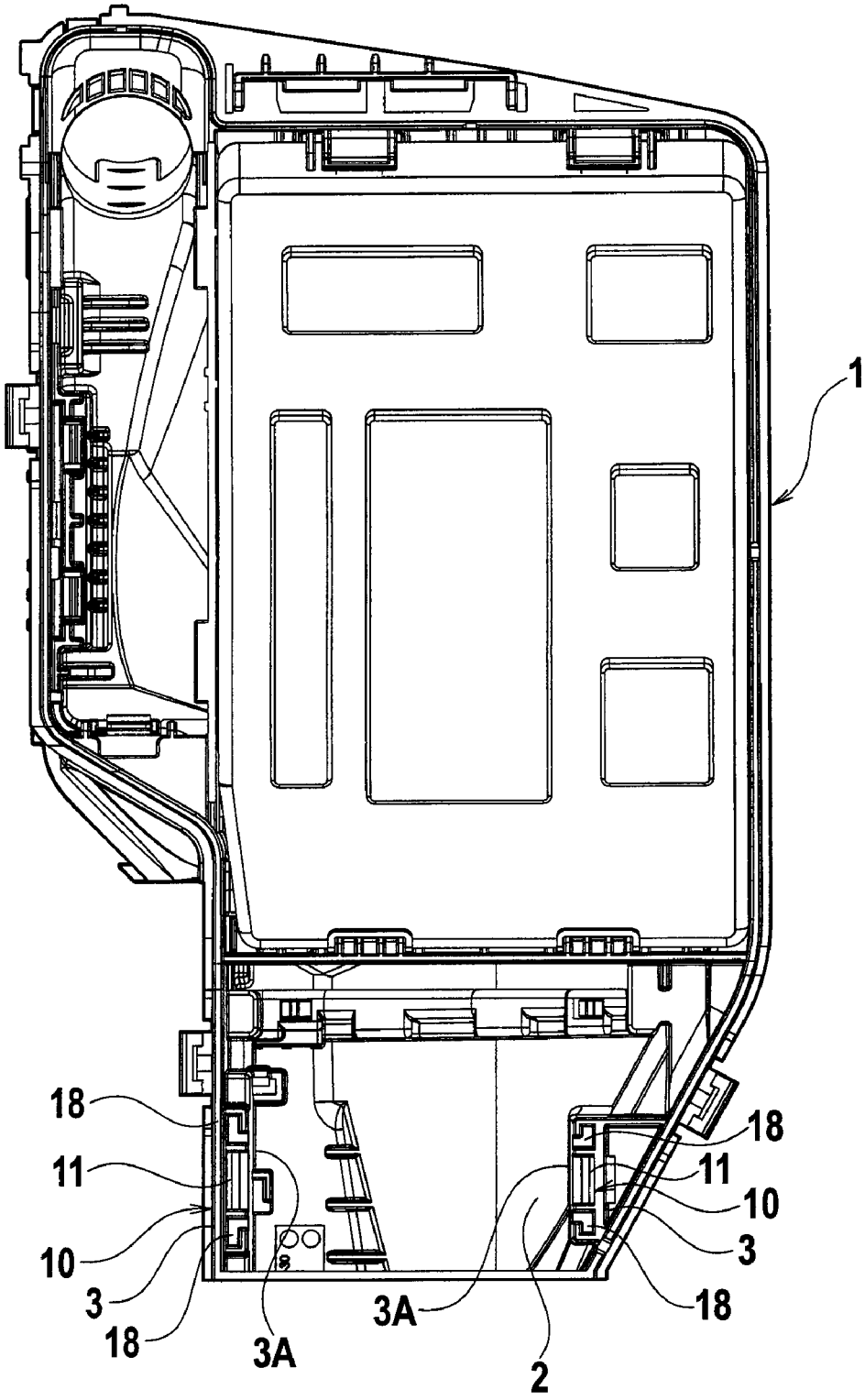
FIG. 2 is a plan view of a box body (a housing box) of the electrical junction box.

As shown in FIGS. 1 and 2, this electrical junction box includes a connector frame housing unit 2 at a side in a box body (a housing box) 1 made of synthetic resin. The housing unit 2 is capable of accommodating a connector frame (a part) 50 from above. The connector frame 50 is configured to allow a plurality of connectors to be mounted thereon and has a rectangular frame shape. There are lock mechanisms to lock the connector frame 50 between sidewalls 3 of the connector frame housing unit 2 of the box body 1 and respective sidewalls 51 (first sidewalls) of the connector frame 50. Each of the lock mechanisms includes a lock unit 10 (a second lock unit) provided for the box body 10 and a lock unit 60 (a first lock unit) provided for the connector frame 50.

Figure 6:
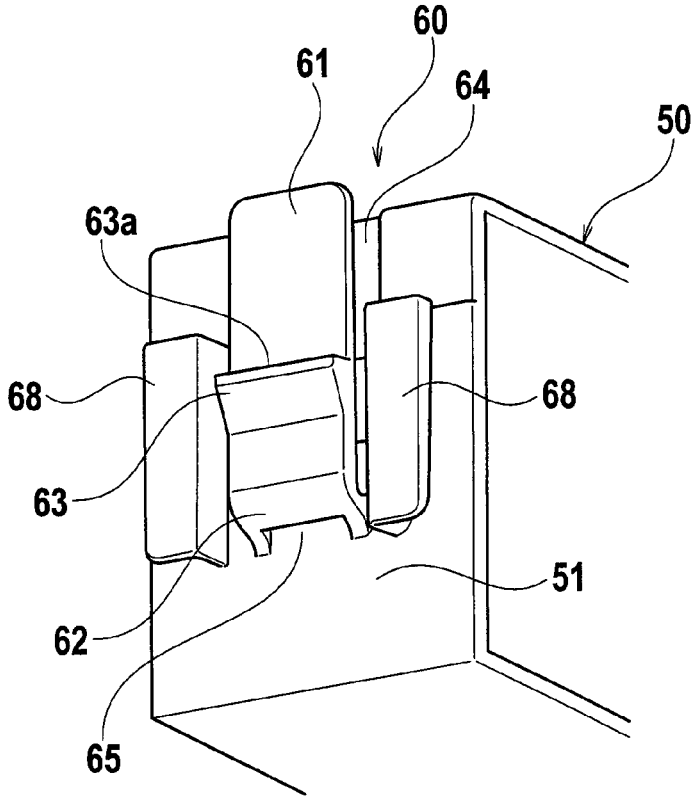
FIG. 6 is a bottom perspective view of the lock unit of a connector frame accommodated in the connector frame housing unit of the box body.
Figure 7:
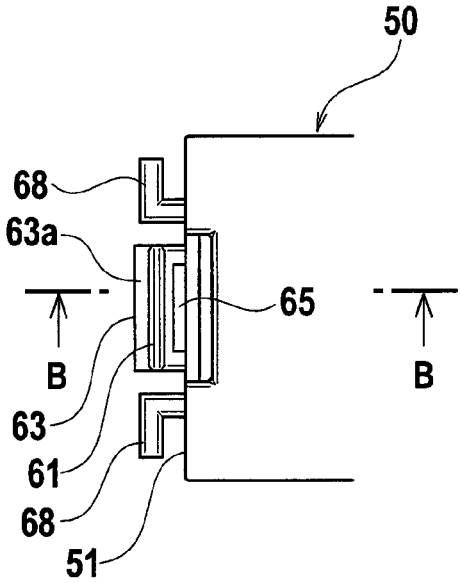
FIG. 7 is a top plan view of the lock unit.
Figure 8:
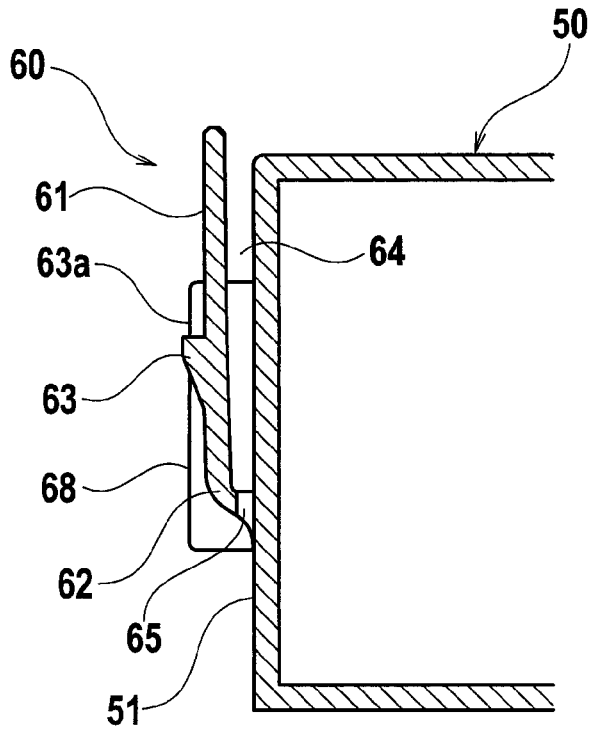
FIG. 8 is a cross-sectional view taken along a line B-B of FIG. 7.
Figure 9:
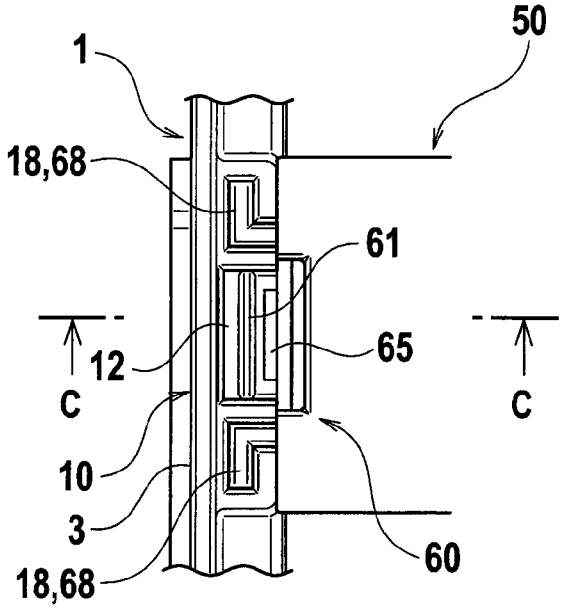
FIG. 9 is a plan view of the lock mechanism where the connector frame is accommodated in the box body and the lock units are locked to each other.

As shown in FIGS. 6 to 8, on an outer surface of each vertical sidewall 51 of the connector frame 50, a lock arm 61 and slide guides 68 (first slide guides), which constitute the lock unit 60, are provided. The lock arm 61 is formed into a cantilevered band plate which is connected to the sidewall 51 at the lower end thereof through a curved supporting unit 62 interposed therebetween. Moreover, the lock arm 61 extends upward from the supporting unit 62 with a deflection space 64 in which the lock arm is deflected to the outer surface of the sidewall 51.

In the middle of the curved supporting unit 62 in the width direction thereof, a slit 65 is provided to increase flexibility of the lock arm 61. In the middle of the outer surface of the lock arm 61 in the extending direction, an engagement protrusion (a first engagement protrusion) 63 including an upward-facing engagement surface 63*a* is provided. The rail-shaped slide guides 68 vertically extend on both sides of the lock arm 61.

Figure 3:
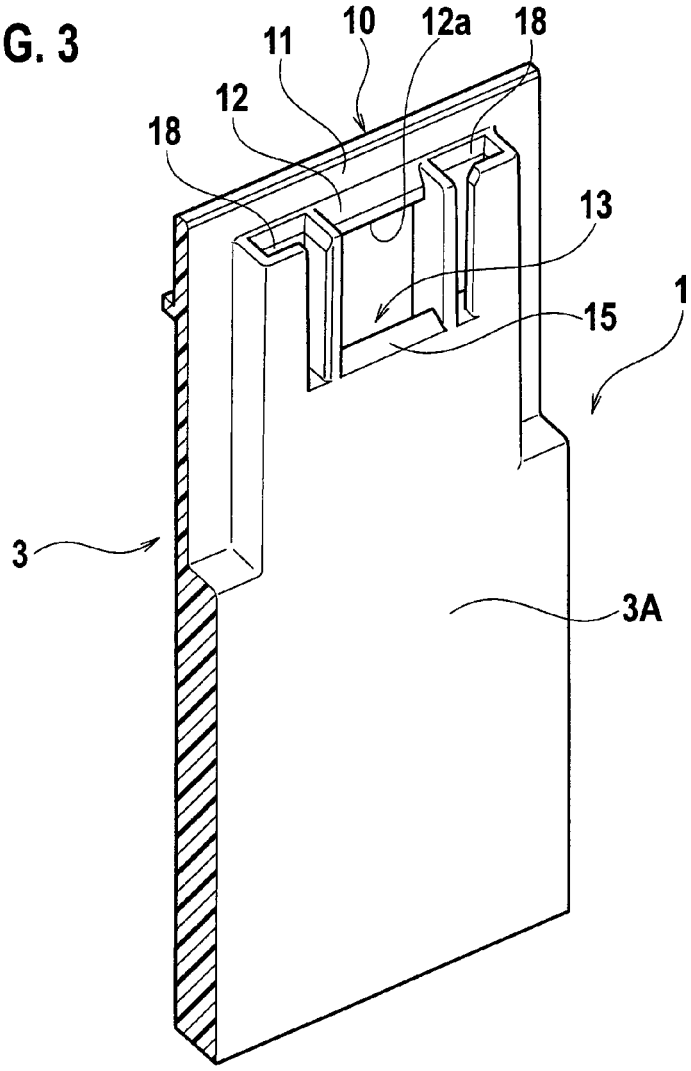
FIG. 3 is an inner perspective view of a lock unit provided for a connector frame housing unit of the box body.
Figure 4:
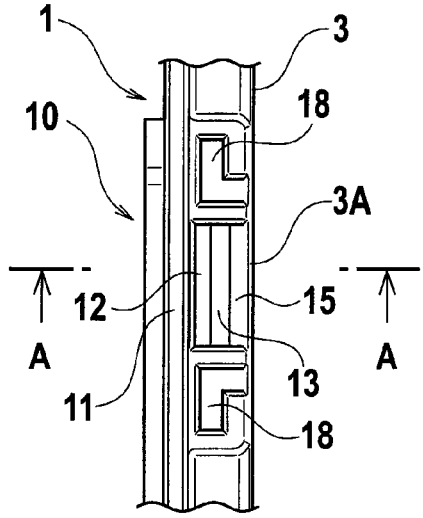
FIG. 4 is a top plan view of the lock unit.
Figure 5:
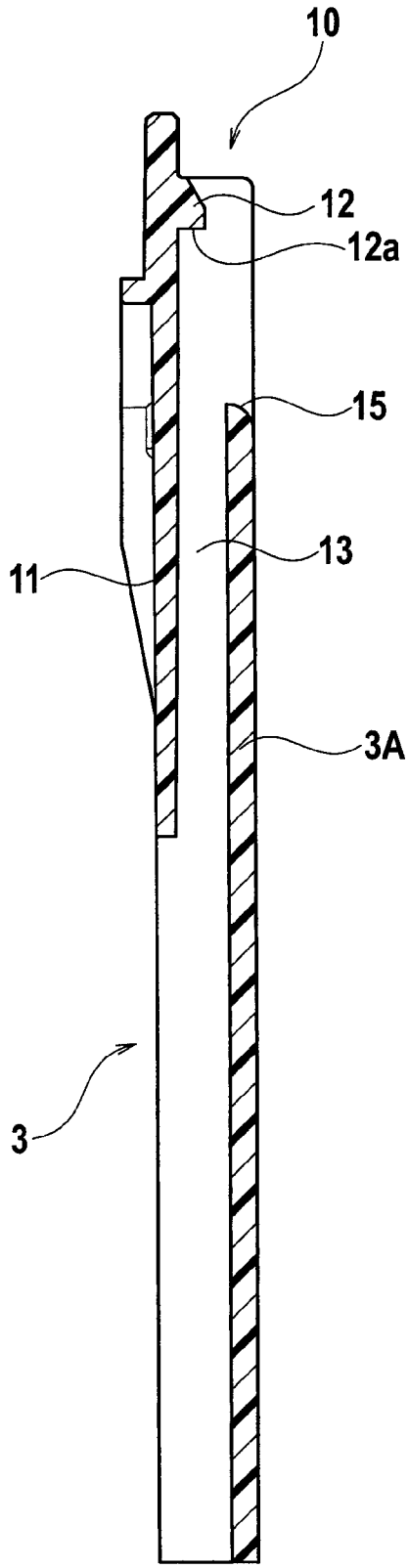
FIG. 5 is a cross-sectional view taken along a line A-A of FIG. 4.

As shown in FIGS. 3 to 5, each of the sidewalls 3 of the connector frame housing unit 2 of the box body 1 includes a fitting sidewall 3A (a second sidewall), to which the sidewall 51 of the connector frame 50 is fitted from above, is provided. In the outside of the fitting sidewall 3A, a plate-shaped lock wall 11 (a third sidewall), which includes a lock protrusion (a second engagement protrusion) 12 on the inner surface thereof, is provided substantially in parallel to the fitting sidewall 3A. The lock protrusion 12 includes a downward-facing engagement surface 12*a*, which is engaged with the engagement protrusion 63 of the lock arm 61.

Figure 10:
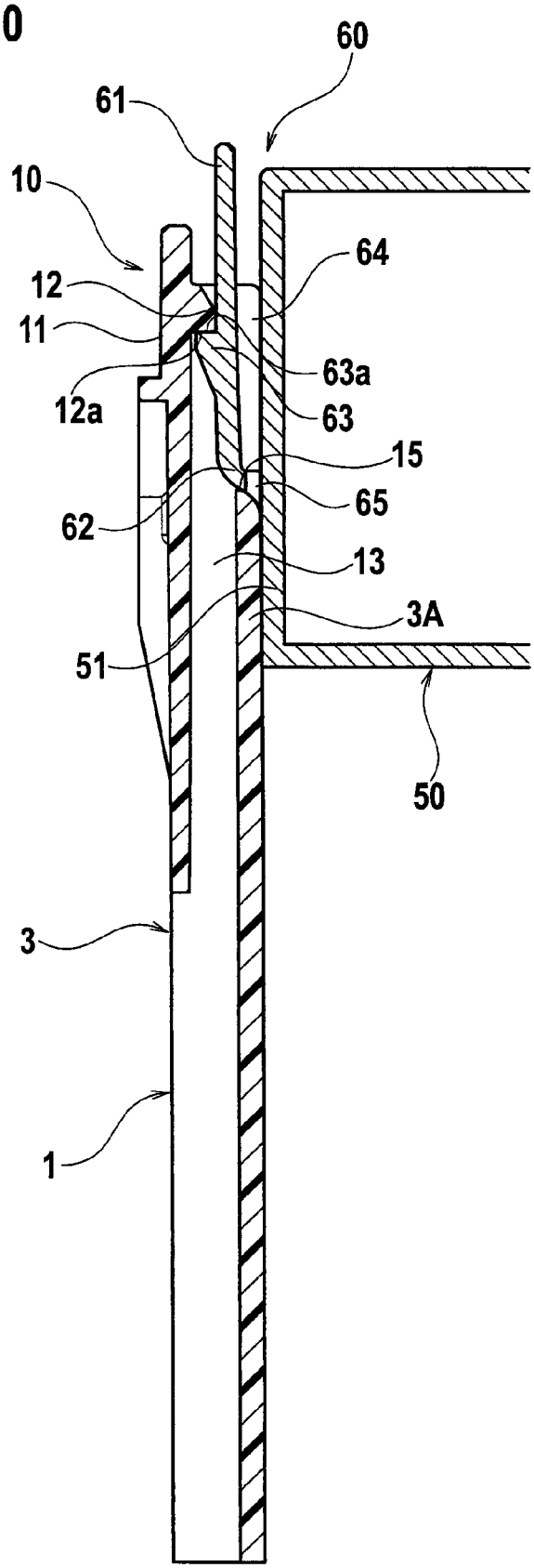
FIG. 10 is a cross-sectional view taken along a line C-C of FIG. 9.

Between the fitting sidewall 3A and lock wall 11, a mold hole 13 used to form the downward-facing engagement surface 12*a* of the lock protrusion 12 is provided. At the upper end of the fitting sidewall 3A, as shown in FIG. 10, an abutment surface 15 is provided. The abutment surface 15 is brought into contact with the curved outer surface of the supporting unit 62 of the lock arm 61 to close communication between the mold hole 13 of the box body 1 and the slit 65 of the connector frame 50.

Moreover, in the inner surface of the lock wall 11, slide guides 18 (second slide guides) are provided. The slide guides 18 are positioned on both sides of the lock protrusion 12 and individually engaged with the slide guides 68 of the lock arm 61 so as to slide vertically.

Next, a description is given of an operation of the lock mechanism.

To accommodate the connector frame 50 in the box body 1, the connector frame 50 is inserted into the connector frame housing unit 2 of the box body 1 from above. As the connector frame 50 is inserted, the lock arm 61 is bent, and the engagement protrusion 63 on the lock arm 61 gets over the lock protrusion 12 of the box body 1. Thereafter, the engagement surfaces 63*a* and 12*a* are struck each other. The engagement protrusion 63 and lock protrusion 12 are thus locked to restrict upward movement of the connector frame 50.

Moreover, the outer surface of the supporting unit 62 of the lock arm 61 is brought into contact with the abutment surface 15 of the upper end of the fitting sidewall 3A to restrict downward movement of the connector frame 50. Moreover, such contact closes the communication between the mold hole 13 of the body box 1 and the slit 65 of the connector frame 50, thus preventing water intrusion inside the abutment surface 15.

In other words, if the mold hole 13 of the box body 1 and the slit 65 communicate with each other, water droplets can enter the box through such a path. However, by bringing the abutment surface 15 of the box body 1 into close contact with the supporting unit 62 of the lock arm 61, the communication between the mold hole 13 and slit 65 can be closed, thus increasing the waterproof ability. Adding such a simple structure can solve the structural problem (specifically, the problem that forms a path allowing water to intrude therethrough).

Moreover, the slide guides 68 are provide on both sides of the lock arm 61 and are engaged with the slide guides 18 of the lock wall 11. Accordingly, the lock protrusion 12 of the box body 1 and the engagement protrusion 63 of the lock arm 61 of the connector frame 51 can be smoothly engaged with each other. Moreover, the slide guides 68 and 18 can receive external force other than force in a direction where the box body 1 is fitted to the connector frame 50 (or vertical force). This prevents unnecessary force from being applied to the lock part, thus stabilizing the locked state.

What is claimed is:

1. A combination of a part and a housing box which accommodates the part, wherein:

the part includes a cantilevered first lock unit provided on a first sidewall of the part, the first lock unit including:

a supporting unit having a curved surface, the curved surface including two outer portions that are connected to the first sidewall, and a middle portion that is positioned between the two outer portions and separated from the first sidewall by a slit;

a lock arm having a band plate shape, extending upward from the supporting unit, and being deflectable toward the first sidewall; and a first engagement protrusion positioned on the lock arm, and extending away from the first sidewall; and the housing box includes a second lock unit that is engageable with the first lock unit, the second lock unit including:

a second sidewall of the housing box;

a third sidewall of the housing box that is substantially parallel to the second sidewall;

a second engagement protrusion positioned on the third sidewall, and engageable with the first engagement protrusion;

a mold hole positioned between the second and third sidewalls; and an abutment surface positioned at an upper end of the second sidewalk, and configured to prevent communication between the mold hole and the slit by, when the second engagement protrusion engages the first engagement protrusion, contacting the curved surface of the supporting unit.

2. The combination according to claim 1, wherein the first engagement protrusion includes an upward-facing engagement surface, and the second engagement protrusion includes a downward-facing engagement surface that is engageable with the upward-facing engagement surface.

3. The combination according to claim 1, wherein:

the first lock unit further includes first slide guides vertically provided on both sides of the lock arm on the first side wall; and the second lock unit further includes second slide guides provided on both sides of the second engagement protrusion on the third sidewall, wherein the first and second slide guides are vertically and slidably engageable with each other.

* * * * *

UNITED STATES PATENT AND TRADEMARK OFFICE

CERTIFICATE OF CORRECTION

PATENT NO. : 7,748,756 B2
APPLICATION NO. : 11/965232
DATED : July 6, 2010
INVENTOR(S) : Masahiro Kanamaru et al.

It is certified that error appears in the above-identified patent and that said Letters Patent is hereby corrected as shown below:

In the Claims:

In claim 1, column 4, line 45, “sidewalk,” should read --sidewall,--.

In claim 3, column 4, line 58, “side wall;” should read --sidewall;--.

Signed and Sealed this

Twenty-first Day of September, 2010

David J. Kappos

David J. Kappos
*Director of the United States Patent and Trademark Office*